US005289774A

United States Patent [19]

Stanka

[11] Patent Number: 5,289,774

[45] Date of Patent: Mar. 1, 1994

[54] SHEET-CLEANING APPARATUS

[75] Inventor: Herbert Stanka, Friedberg, Fed. Rep. of Germany

[73] Assignee: Baldwin-Gegenheimer GmbH, Friedberg, Fed. Rep. of Germany

[21] Appl. No.: 926,748

[22] Filed: Aug. 7, 1992

[30] Foreign Application Priority Data

Aug. 14, 1991 [DE] Fed. Rep. of Germany ..... 4126888

[51] Int. Cl.[5] ..... B41F 35/00; B41L 41/00

[52] U.S. Cl. ..... 101/423; 101/417; 101/416.1; 101/425

[58] Field of Search ..... 101/416.1, 417, 418, 101/423, 424, 424.1, 424.2, 425, DIG. 45

[56] References Cited

U.S. PATENT DOCUMENTS

| | | | |
|---|---|---|---|
| 3,245,835 | 4/1966 | Gallino . | |
| 4,458,376 | 7/1984 | Sitko . | |
| 4,643,775 | 2/1987 | Reba et al. . | |
| 4,757,763 | 7/1988 | MacPhee et al. | 101/425 |
| 4,986,182 | 1/1991 | Sawaguchi et al. | 101/423 |
| 5,040,462 | 8/1991 | Hillenbrand et al. | 101/425 |
| 5,105,740 | 4/1992 | Loos et al. | 101/425 |
| 5,117,754 | 6/1992 | Nozaka et al. | 101/425 |
| 5,148,746 | 9/1992 | Fuller et al. | 101/467 |

FOREIGN PATENT DOCUMENTS

| | | | |
|---|---|---|---|
| 0126613 | 11/1984 | European Pat. Off. | 101/DIG. 45 |
| 0186620 | 7/1986 | European Pat. Off. | 101/DIG. 45 |
| 0299203A2 | 6/1988 | European Pat. Off. . | |
| 50672 | 3/1889 | Fed. Rep. of Germany . | |
| 483216 | 9/1929 | Fed. Rep. of Germany . | |
| 685785 | 7/1938 | Fed. Rep. of Germany . | |
| 1786277 | 10/1968 | Fed. Rep. of Germany . | |
| 2249740B2 | 11/1972 | Fed. Rep. of Germany . | |
| 3005469C2 | 2/1980 | Fed. Rep. of Germany . | |
| 3740044A1 | 11/1987 | Fed. Rep. of Germany . | |
| 8813228.5 | 10/1988 | Fed. Rep. of Germany . | |
| 0233527 | 3/1986 | German Democratic Rep. | 101/DIG. 45 |
| 401038238 | 2/1989 | Japan | 101/DIG. 45 |
| 2-003308 | 8/1990 | Japan . | |
| 1082910 | 9/1967 | United Kingdom . | |
| 2047167A | 1/1980 | United Kingdom . | |

OTHER PUBLICATIONS

Xerox Disclosure Journal, "Moisture Sensor", vol. 8 No. 6, Nov./Dec. 1983, pp. 519-520.

Xerox Disclosure Journal; vol. 14 No. 1, Jan./Feb. 1989, (p. 21) "Web Cleaning System".

Xerox Disclosure Journal; vol. 9 No. 4 Jul./Aug. 1984, (p. 271), "Tape Cleaner".

*Primary Examiner*—Edgar S. Burr
*Assistant Examiner*—Lynn D. Hendrickson
*Attorney, Agent, or Firm*—Darby & Darby

[57] ABSTRACT

A sheet-cleaning apparatus for cleaning a sheet (6) that is to be printed, before it runs into the printing mechanism (2) of a sheet-fed printing press. A backing cloth (20), which is contacted with the sheet (6) that is to be printed with the help of the positioning means, is used to clean the sheet (6) that is to be printed. A transporting apparatus (26, 24, 28) transports the backing cloth (20), so that other moist sections (32) of the backing cloth (20) are consecutively brought into contact with the sheet (6) that is to be printed.

12 Claims, 2 Drawing Sheets

SHEET-CLEANING APPARATUS

FIELD OF THE INVENTION

The invention relates to a sheet-cleaning apparatus, and, more particularly to an apparatus for cleaning a sheet that is to be printed, before the sheet runs into the printing mechanism of a sheet-fed printing press.

BACKGROUND OF THE INVENTION

Prior to actual printing of sheet material, dust and other dirt particles deposit on the sheet to be printed, particularly if the sheet is electrostatically charged by friction or other influences. The sheet is typically paper, but may also include other materials or be coated with aluminum or plastic, for example. Such dirt particles impair the quality of the printing and decrease the life expectancy of the backing cloths (rubber cloths) and the printing mechanism as well.

Known apparatuses for cleaning the sheet before it is printed in the printing mechanism consist of suction nozzles, which vacuum the dirt particles from both sides of the sheet. It is also possible to use brushes for brushing off the sheet. Both known possibilities have the disadvantage of scratching the surface of the sheet, and causing the fibers of the sheets to be upright. These upright fibers are then torn off in the printing mechanism and adversely affect the backing cloth and the quality of the printing.

SUMMARY OF THE INVENTION

It is an object of the invention to eliminate dirt particles on the sheets to be printed to improve the quality of the printing, lengthen the operating time between cleanings of the backing cloths, and increase the lifetime of the backing cloths and the printing mechanisms.

BRIEF DESCRIPTION OF THE DRAWINGS

The invention is described in the following with reference to the drawings by means of preferred embodiments as examples. In the drawings.

DESCRIPTION OF THE PREFERRED EMBODIMENTS

Figure 1:
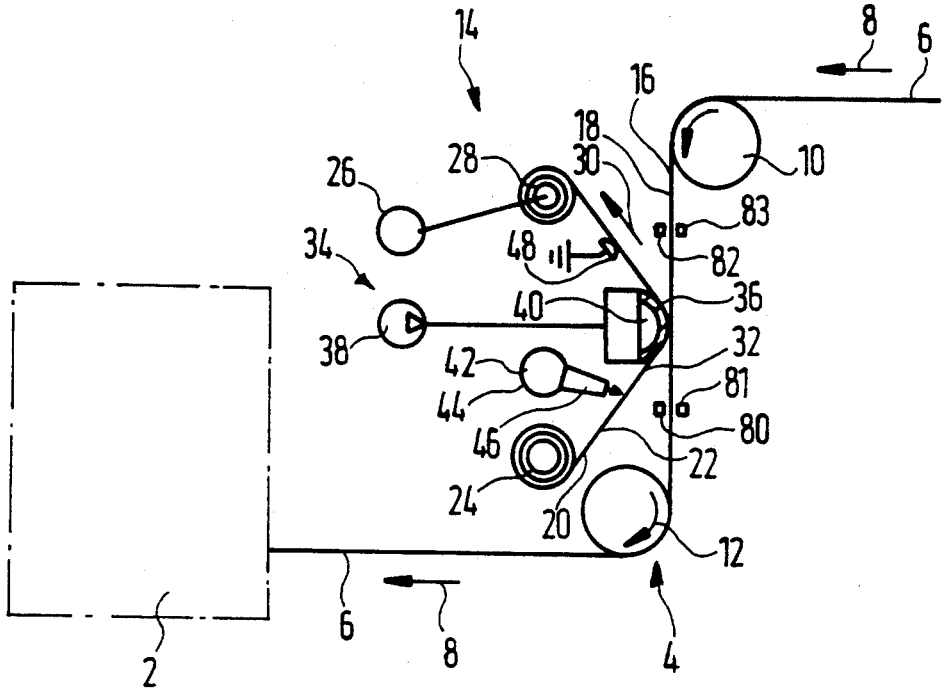
FIG. 1 diagrammatically shows a side view of an inventive sheet-cleaning installation, which precedes a printing mechanism and is integrated in a pull unit.

FIG. 1 diagrammatically shows a printing mechanism 2 (in phantom), to which a sheet 6 to be printed is supplied from a pull unit 4 in the direction of the arrows 8. Only two of the transporting rollers 10 and 12 of the pull unit 4, which transport the sheet 6, are shown. A sheet-cleaning installation 14 is integrated into the pull unit 4 and serves to clean the sheet 6 on the one side 16 of the sheet as it travels along section 18, located between the rollers 10 and 12. The sheet 6 can consist of paper or other material, or a multi-layer sheet of the same or different materials. For example, the sheet 6 to be printed can be a plastic-coated paper sheet.

The sheet-cleaning installation 14 contains a backing cloth 20, which is approximately as wide as the sheet 6. The backing cloth 20 can be a single-layer or a multi-layer cloth and may be made of, for example, wool, leather or, preferably a nonwoven fabric. These materials are given as examples because it is important that the backing cloth 20 store liquid on the side 22 which contacts the sheet 6 and that this liquid, on contact with the sheet 6 form a lubricating film and supports the transfer of dirt particles from the sheet 6 to the backing cloth 20. The backing cloth 20 is very long and is unwound from a clean cloth roller 24 and is wound up in the direction of an arrow 30 onto a dirty cloth roller 28 that is driven by a motor 26. For the duration of this winding process, the section 32 of backing cloth 20, which is between these two rollers 24 and 28, can be lifted up from the sheet 6 that is to be printed.

A positioning apparatus 34, which contains a membrane 36 that can be expanded in the direction of the sheet section 18 and a compressed air source 38, provides for making and breaking the contact between the backing cloth section 32 and the sheet section 18. Compressed air from the source 38 produces pressure in a pressure chamber 40, which pressure pushes the membrane in the direction of the sheet section 18. The membrane 36 is elastic, so that it draws back from the sheet section 18 when the pressure is reduced in the pressure chamber 40 and, in so doing, breaks the contact between the backing cloth section 32 and the sheet section 18.

Preferably, the backing cloth 20 is not wound by the motor 26 on the dirty cloth roller, but held stationary while it is in contact with the section 18 of the sheet 6. For the wiping-off effect, at least a small relative motion is required between the backing cloth 20 and the sheet 6. This relative motion can be brought about by moving the sheet 6 relative to the stationary backing cloth 20 or by movements of both the sheet 6 and the backing cloth 20.

The cleaning action is intensified if, pursuant to the invention, the backing cloth 20 is moist at least in the section 32 of its side 22 facing the sheet 6. The backing cloth 20 can be pre-moistened on the clean cloth roller 24. In the case of the embodiment shown in FIG. 1, however, the section of the backing cloth 20, which is wound up on the clean cloth roller 24, is dry and only that section 32 of the backing cloth 20 is moistened with liquid, preferably water, by means of a moistening apparatus 42. The moistening-apparatus 42 is activated automatically by the motor 26 so that moisture is applied to the next section of backing cloth 20 which is to be moved onto the membrane 36 and subsequently placed into contact with the sheet section 18.

The membrane 36 extends over the entire width of the backing cloth 20 and also over the entire width of the sheet 6 to be printed. The moistening apparatus 42 moistens the backing cloth 20 over its entire width. The moistening apparatus 42 can be a pipe 44 with a plurality of nozzles 46, through which a contact liquid, preferably water, is applied, for example by spraying, on the backing cloth section 32, which is the next section to be moved onto the membrane 36. The backing cloth 20 can also be wetted or impregnated by supplying the liquid essentially without employing pressure, for example, through a slotted opening or by the wicking principle.

In order to prevent the dirt particles, wiped off by the backing cloth 20 from the sheet 6 from falling into the inlet gap between a roller, for example, the roller 12 of the pull unit 4 and the sheet 6, the apparatus of FIG. 1 is arranged so that the sheet section 18 moves from top to bottom and the backing cloth section 32 from the bottom to the top. Preferably, however, the backing cloth 20 is moved only when it is not in contact with the sheet 6 that is to be printed. It is, however, also possible to transport the backing cloth 20 also when it is in contact with the sheet 6, as shown in FIG. 1. However, there must always be a relative motion between the sheet 6 and the backing cloth 20, if a "wiping-off effect" is to be achieved.

Generally, particles are deposited on the sheet 6 due to gravity. If the sheet 6 is electrostatically charged dirt particles are also held fast by electrostatic attraction. To improve the cleaning action and also to avoid a subsequent, renewed contamination, the sheet 6 is electrically discharged. This is accomplished by placing the moist backing cloth section 32 in contact with a ground connection 48. The ground connection 48 can be formed, for example, by an electrode that is at right angles to and in contact with the moist backing cloth 20. Because of the moisture and the adsorbed soil, the dirty side of the backing cloth 20 is a good conductor. So that is does not wipe off the dirt, the electrode 48 can be disposed on the clean side of the backing cloth 20, as shown in FIG. 1.

The moisture content of the sheet 6 that is to be printed can be measured before the cleaning by sensors 82 and 83 and after cleaning by sensors 80 and 81. The supply of moistening liquid to the sheet 6 is controlled or regulated, for example, over the moistening apparatus 42 as a function of the moisture content measured. Preferably, a liquid that conducts electricity well, such as water, or a liquid suitable for offset printing, is used to moisten the sheet 6.

Figure 2:
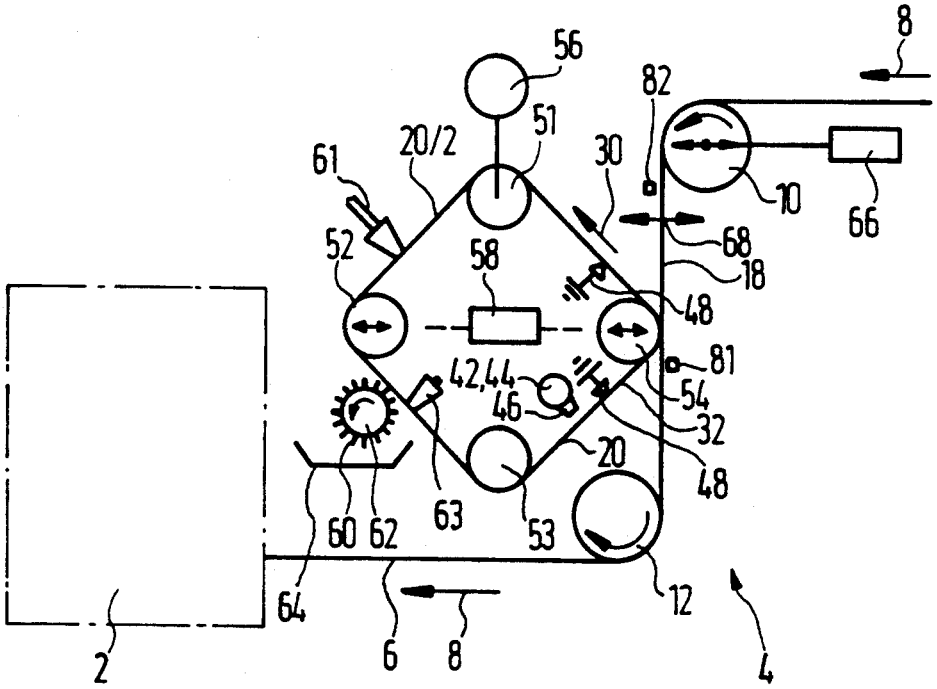
FIG. 2 shows a diagrammatic side view of a further, inventive sheet-cleaning installation.

A further, inventive embodiment is shown in FIG. 2, with common elements identified with the same reference numerals as in FIG. 1. The backing cloth in FIG. 2 is an endless belt 20/2, which runs over rollers 51, 52, 53 and 54, which, for example, is driven by a motor 56 via roller 51. In this case, the rollers 52 and 54 function as positioning means, in that they can be moved by a control mechanism 58 perpendicularly relative to the sheet section 18 for contacting the backing cloth section 32 with this section 18 of the sheet. Section 32 of the backing cloth is moistened with the moistening apparatus 42 and grounded with a ground connection 48 as previously described. The endless backing cloth 20/2 can revolve several times. In this particular case, it is advisable that, before each revolution, the backing cloth 20/2 be cleaned by a cleaning apparatus 60. The cleaning apparatus 60 can be a suction nozzle 61 on the dirty side and/or a blowing nozzle 63 on the clean side of the backing cloth 20/2 and/or a rotating brush 62, which transfers the dirt particles, which have been brushed off from the backing cloth 20/2, to a collector 64.

The inventive embodiment shown in FIG. 2 contains a further variation in the form of a second positioning means or a regulating drive 66 for moving the roller 10 relative to the rollers 51 to 54 of the backing cloth 20/2, in order to make or break contact between the section 18 of the sheet and the backing cloth section 32 at the periphery of the roller 54. For this purpose, the section 18 of backing cloth of the sheet 6 is moved forwards or backwards by the second positioning means 66 in accordance with the double arrow 68 shown in FIG. 2.

Figure 3:
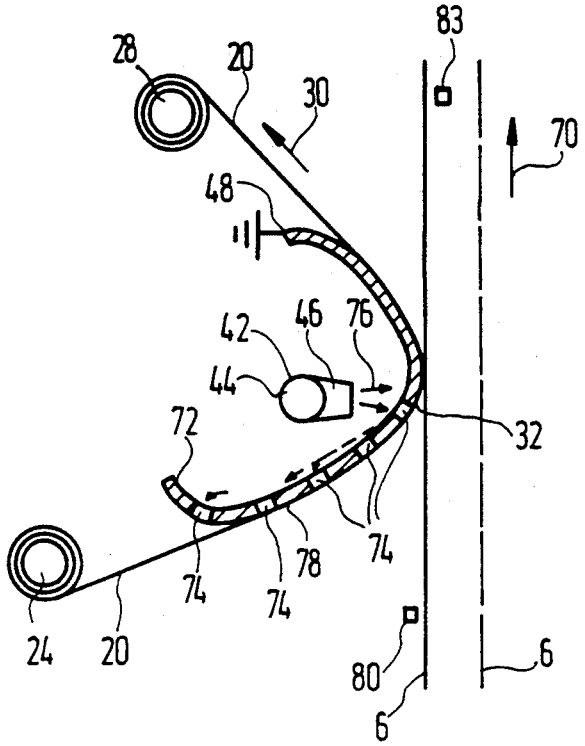
FIG. 3 diagrammatically shows a side view of yet another embodiment of an inventive sheet-cleaning installation.

In a further embodiment of an inventive sheet-cleaning installation shown in FIG. 3, the sheet 6 that is to be printed is shown as a solid line in the position in which it contacts the backing cloth 20 in section 32. The broken line indicates the position the sheet 6 is in when not contacting the backing cloth 20. If no machinery parts are disposed below the section 32 of backing cloth which contacts the sheet 6, or if there is no danger for some other reason that dirt particles, falling down from section 32 of backing cloth, can cause contamination of machinery parts, then the sheet 6 can also be moved upwards, as shown by arrow 70, instead of downwards.

For the embodiment shown in FIG. 3, the second positioning means 66 of FIG. 2 can be provided once again for making and breaking contact. For the embodiment of FIG. 3, the section 32 of backing cloth, which is to be contacted with the sheet 6 that is to be printed, runs over a perforated guiding plate 72 with a plurality of boreholes 74, through which the water 76, which is sprayed by the nozzles 46, is distributed against the direction of motion 30 of the backing cloth on a long moistening section 78 of backing cloth 20. The backing cloth 20 has a very large, finite length and runs from a clean cloth roller 24 to a dirty cloth roller 28. The guiding plate 72 can, however, also be used in conjunction with an endless backing cloth 20/2 of FIG. 2. The guiding plate 72 can be provided with the grounding connection 48.

Aside from those named, the means for positioning backing cloth 20 or 20/2 relative to the sheet 6 that is to be printed, or the sheet 6 relative to the backing cloth 20 or 20/2, can also be pneumatic cylinders, hydraulic cylinders, cams and springs.

The switching on and off of the sheet cleaning installation 14 preferably takes place simultaneously and automatically with the switching on and off of the printing mechanism 2. The making and breaking of the contact between backing cloth 20 or 20/2 and the sheet 6 that is to be printed also takes place automatically in particular time periods.

Figure 4:
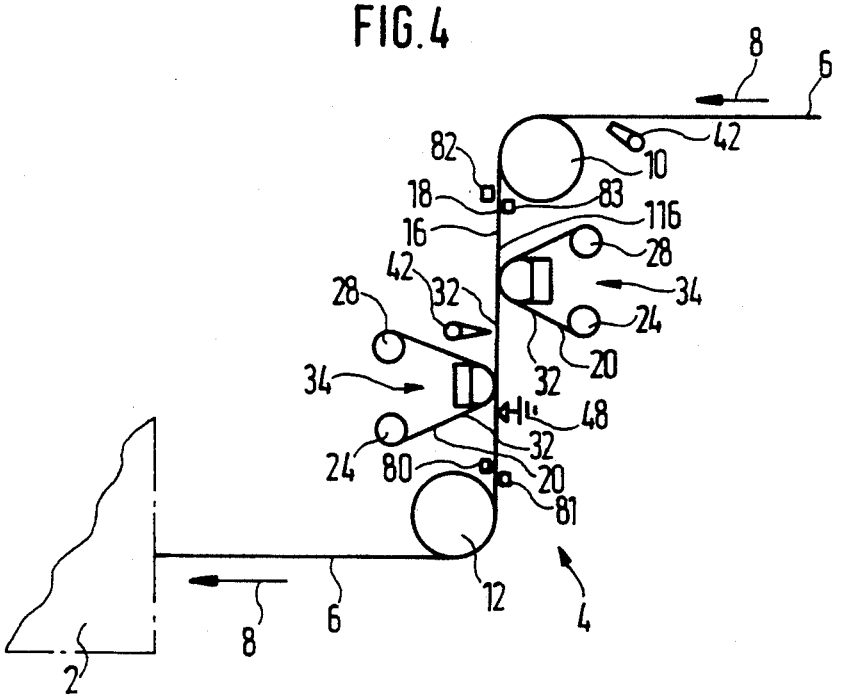
FIG. 4 shows a schematic side view of an inventive sheet-cleaning installation for cleaning both sides of a sheet that is to be printed.

FIG. 4 shows an embodiment of a sheet cleaning installation, in which a backing cloth 20 (or 20/2) is disposed on both sides 16 and 116 of the sheet 6 that is to be printed. The reference numbers for corresponding parts are the same in FIGS. 4 and 1. The sheet 6 that is to be printed is guided over rollers 10 and 12 on a path. The arc of contact over which the sheet 6 surrounds or contacts the rollers 10 and 12 and the section 32 of the backing cloth can be varied by positioning the rollers 10, 12 and/or the section 32 of the backing cloth 20.

I claim:

1. A cleaning apparatus for cleaning a sheet prior to being printed by a printing press, comprising:

(a) sheet transport means for transporting the sheet from an input of the sheet transport means through the cleaning apparatus to an output of the sheet transport means leading to the printing press;

(b) a backing cloth disposed on at least one side of the sheet between the sheet transport means input and output;

(c) positioning means for selectively contacting a section of the backing cloth located between sheet transport means input and output and causing at least a part of said backing cloth section to come into contact with a portion of the sheet in a contact area;

(d) cloth transport means for transporting the backing cloth such that there is at least a small relative motion between the respective sheet portion and backing cloth section when they are brought into contact with each other by the positioning means;

(e) moistening means for moistening the backing cloth section with an electrically conducting liquid at a location just prior to the contact area; and (f) grounding means for contacting the backing cloth section at a location just after the contact area and for substantially eliminating static electricity from the contact area due to conduction of electrical charges by the elctrically conducting liquid.

2. The cleaning apparatus of claim 1, wherein the first positioning means are connected to the backing cloth.

3. The cleaning apparatus of claim 1, wherein the positioning means are connected to the sheet transport means.

4. The cleaning apparatus of claim 1, further including two backing cloths, a first backing cloth contacting a first side of the sheet; and a second backing cloth contacting a second side of the sheet.

5. The cleaning apparatus of claim 1, wherein the positioning means includes an expandable membrane contacting the backing cloth, the membrane being selectively expandable for causing the backing cloth to selectively contact the sheet.

6. The cleaning apparatus of claim 5, further including a pressure source for selectively expanding the expandable membrane.

7. The cleaning apparatus of claim 1, further including a guide plate contacting the backing cloth, the guide plate having a plurality of bore holes for distributing moisture to the backing cloth.

8. The cleaning apparatus of claim 1, further including a controlling means connected to the positioning means for breaking contact between the backing cloth and the sheet when the backing cloth is being transported.

9. The cleaning apparatus of claim 1, wherein the backing cloth is a nonwoven fabric.

10. The cleaning apparatus of claim 1, further comprising:

means for sensing a moisture content of the sheet; and means responsive to the means for sensing moisture content for providing a fluid to moisten the sheet so as to have a predetermined moisture content.

11. The cleaning apparatus of claim 1, wherein the backing cloth is an endless sheet.

12. The cleaning apparatus of claim 11, further including rollers for guiding the backing cloth.

* * * * *